US008910500B2

(12) United States Patent
Baradari et al.

(10) Patent No.: US 8,910,500 B2
(45) Date of Patent: Dec. 16, 2014

(54) LOW FRICTION END FEEDING IN TUBE HYDROFORMING

(71) Applicant: National Research Council of Canada, Ottawa (CA)

(72) Inventors: Javad Gholipour Baradari, Dollard-des-Ormeaux (CA); Priti Wanjara, Pointe-Claire (CA); Eugen Marius Banu, Notre Dame de I'lle Perrot (CA); Horatiu Daniel Chiriac, Montreal (CA)

(73) Assignee: National Research Council of Canada, Ottawa, Ontario (CA)

( * ) Notice: Subject to any disclaimer, the term of this patent is extended or adjusted under 35 U.S.C. 154(b) by 0 days.

(21) Appl. No.: 14/022,908

(22) Filed: Sep. 10, 2013

(65) Prior Publication Data

US 2014/0069160 A1 Mar. 13, 2014

Related U.S. Application Data

(60) Provisional application No. 61/698,858, filed on Sep. 10, 2012.

(51) Int. Cl.

| | |
|---|---|
| ***B21D 26/02*** | (2011.01) |
| ***B21D 9/15*** | (2006.01) |
| ***B21D 26/045*** | (2011.01) |
| ***B21D 26/033*** | (2011.01) |
| ***B21D 26/043*** | (2011.01) |

(52) U.S. Cl.

CPC ..... *B21D 26/033* (2013.01); *B21D 26/045* (2013.01); *B21D 26/043* (2013.01)

USPC ..... 72/62; 72/58; 72/370.06; 72/370.22; 29/421.1

(58) Field of Classification Search

USPC ..... 72/58, 61, 62, 370.06, 370.22; 29/421.1

See application file for complete search history.

(56) References Cited

U.S. PATENT DOCUMENTS

| | | | | |
|---|---|---|---|---|
| 2,830,831 | A | | 4/1958 | Bosch |
| 2,837,810 | A | | 6/1958 | Ekholm |
| 3,625,040 | A | | 12/1971 | De Gain |
| 4,167,388 | A | | 9/1979 | Keelor et al. |
| 4,393,674 | A | | 7/1983 | Rasmussen |
| 4,513,598 | A | | 4/1985 | Costabile |
| 4,557,128 | A | | 12/1985 | Costabile |
| 4,761,981 | A | | 8/1988 | Kelly |
| 4,779,333 | A | | 10/1988 | Rabe et al. |
| 4,788,843 | A | | 12/1988 | Seaman et al. |
| 4,802,273 | A | * | 2/1989 | Widart ..... 29/421.1 |
| 4,901,551 | A | * | 2/1990 | Widart ..... 72/58 |
| 4,951,492 | A | | 8/1990 | Vogt |
| 5,233,854 | A | * | 8/1993 | Bowman et al. ..... 72/62 |
| 5,233,856 | A | | 8/1993 | Shimanovski et al. |
| 5,235,836 | A | | 8/1993 | Klages et al. |
| 5,279,142 | A | | 1/1994 | Kaiser |
| 5,321,964 | A | | 6/1994 | Shimanovski et al. |

(Continued)

*Primary Examiner* — David B Jones
(74) *Attorney, Agent, or Firm* — Jason E. J. Davis

(57) ABSTRACT

An end plunger for end feeding during a hydroforming process (such as tube hydroforming) has at least one releasable seal. The effect of the releasable seal is that it avoids pressurizing the blank in a nip area, thereby reducing friction and wear, and allowing increased end feeding with a given end feeding force. The releasable seal may be actuable, for sealing or releasing. The plunger may be modular or monolithic. A kit and method may incorporate the end plunger.

29 Claims, 2 Drawing Sheets

(56) References Cited

U.S. PATENT DOCUMENTS

| | | | |
|---|---|---|---|
| 5,357,774 | A | 10/1994 | Klages et al. |
| 5,445,002 | A | 8/1995 | Cudini et al. |
| 5,511,404 | A | 4/1996 | Klages et al. |
| 5,575,172 | A | 11/1996 | Bonny et al. |
| 5,644,829 | A | 7/1997 | Mason et al. |
| 5,815,901 | A | 10/1998 | Mason et al. |
| 5,918,494 | A | 7/1999 | Kojima et al. |
| 5,979,201 | A | 11/1999 | Horton et al. |
| 5,987,950 | A | 11/1999 | Horton |
| 6,006,567 | A | 12/1999 | Brown et al. |
| 6,012,317 | A | 1/2000 | Bonny et al. |
| 6,014,879 | A | 1/2000 | Jaekel et al. |
| 6,029,487 | A | 2/2000 | Genin et al. |
| 6,089,064 | A | 7/2000 | Tauzer |
| 6,105,409 | A | 8/2000 | Kojima et al. |
| 6,151,940 | A | 11/2000 | Amborn et al. |
| 6,176,114 | B1 | 1/2001 | Gmurowski |
| 6,216,509 | B1 | 4/2001 | Lotspaih et al. |
| 6,237,382 | B1 | 5/2001 | Kojima et al. |
| 6,257,035 | B1 | 7/2001 | Marks et al. |
| 6,279,364 | B1 | 8/2001 | Morphy et al. |
| 6,415,638 | B1 | 7/2002 | Sakurai et al. |
| 6,446,476 | B1 | 9/2002 | Gmurowski |
| 6,591,650 | B2 | 7/2003 | Engel et al. |
| 6,637,246 | B1 | 10/2003 | Shimanovski et al. |
| 6,662,611 | B2 | 12/2003 | Janssen et al. |
| 6,732,560 | B1 | 5/2004 | Winterhalter et al. |
| 6,804,979 | B2 | 10/2004 | Gomez |
| 6,826,943 | B2 | 12/2004 | Rempe et al. |
| 6,912,884 | B2 | 7/2005 | Gharib |
| 7,013,697 | B2 | 3/2006 | Barber |
| 7,051,768 | B2 | 5/2006 | Takahashi |
| 7,059,033 | B2 | 6/2006 | Bruggemann |
| 7,096,700 | B2 | 8/2006 | Marando |
| 7,140,217 | B1 | 11/2006 | Marks et al. |
| 7,284,403 | B2 | 10/2007 | Wagner et al. |
| 7,392,679 | B1 | 7/2008 | Ghiran et al. |
| 7,426,845 | B2 | 9/2008 | DiCesare |
| 8,117,883 | B2 * | 2/2012 | Simpson et al. ..... 72/58 |
| 2005/0126243 | A1 | 6/2005 | Lee |
| 2007/0107480 | A1 | 5/2007 | Dudziak et al. |
| 2008/0121007 | A1 | 5/2008 | Ingvarsson |

* cited by examiner

LOW FRICTION END FEEDING IN TUBE HYDROFORMING

This application claims the benefit of U.S. Provisional Patent Application Ser. No. 61/698,858 filed Sep. 10, 2012, the entire contents of which is herein incorporated by reference.

FIELD OF THE INVENTION

The present invention relates in general to end fed tube hydroforming, and more particularly to the use of at least one releasable seal (multi-stage sealing) for reducing and localizing friction during end feeding.

BACKGROUND OF THE INVENTION

Tube hydroforming (THF) is relatively a new process for manufacturing structural components in various industries, such as aerospace, automotive and marine. Compared to the traditional manufacturing processes, such as stamping and welding, this technique presents many advantages, such as lower weight to rigidity ratio in the component, better stress distribution in the resulting part, and less effort to form joints or contours, including complex shapes. Moreover, THF can provide sharper corners and more easily produces a variety of shapes that are difficult to produce with the forming and welding of several parts.

A schematic illustration of a hydroforming press is shown in FIG. 1. In this process, tubular blank 10 is placed inside a die 12 and the die is closed. While the blank 10 shown is straight, with circular cross-section, it is known to use a pre-bent/preformed blank with variety of cross sections, and while the die 12 shown has symmetric walls, it is known that a wide variety of die shapes are possible. Then, the ends of the tube are sealed by end plungers 15 which have channels 16 therein for injection and venting of a pressurized fluid (which may be water, as the name suggests, but may be other liquids or gasses). While the end plungers 15 seal against the interior volume of the blank 10, the pressurized fluid is applied, and the blank 10 plastically deforms until it takes the shape of the die cavity. The pressurized fluid is vented, the die is opened, and the formed piece is removed.

One of the greatest limitations on THF is the formability of the material. To conform to a die wall that is substantially far from the unstressed blank wall, the blank material needs to exhibit considerable ductile strain. After the material's elongation is spent, the tube cannot safely deform any more without rupturing. Even before rupture, selective thinning in the areas where the blank is deformed, generally leads to a weakening of the material and may not be desirable. To control thickness at critical locations in hydroformed parts, either the blank material needs to be changed (i.e. replaced with a more deformable material) or the thickness of the material needs to be increased. In many applications, neither of these options is preferable, since both can result in changes in the mechanical properties, cost, weight and service behavior of the final product. Typically it would be preferred to increase the formability of the material during the hydroforming process by feeding more material to the expanding/deforming zone. This can be realized by applying more force at the ends of the tube than is required to maintain a seal between the tube and plungers.

In this way, the tube ends migrate towards a centre of the die cavity, thereby feeding more material to the deforming zone. This is called end feeding and is well known and addressed in the open literature. Thus, it is known to applying a compressive force on the blank 10 via end plungers 15 during the pressurization and deformation. The compressive loading adds some complexity to the requirements for the end plungers 15 and die 12, but can substantially improve a range of products and properties of the products that can be derived from a tube hydroforming apparatus.

Unfortunately, there are several limitations on how much end feeding a system can provide. Not the least of the problems is that of friction in nip areas 17 of the system, i.e., where the end plungers 15 seal against the blank 10, and the blank 10 is supported by the die 12 to prevent expansion of the blank 10 near its ends. Fluid pressure at the end feeding region of the tube is equal to the pressure applied inside the tube. Here a substantial advantage of the hydroforming process—the fact that uniform pressure is applied evenly across the internal surface of the blank 10—works against the desire for substantial end feeding, in that the friction resists end feeding, requiring greater force, this friction wears out the cavity in the nip areas 17, as well as the end plungers 15.

Furthermore, in typical conventional end feeding, in most cases, the material begins to fold or to get thicker (crumpling or thickening) at the end feeding region due to the friction leading to further artifacts that are typically not desired in the end products (which may contribute to wasted material that needs to be removed) further reduces the efficiency of the end feeding, in that less fed material is driven into the cavity centre. This further requires more force to be applied to the tube ends for a given desired amount of end feeding being delivered further into the die. Again this further force exacerbates the friction and the folding.

End feeding does not have to be limited to THF. Any effectively closed chamber with one or more openings that can be sealed to form a closed cavity can be formed with an analogous hydroforming technique, and end feeding can be applied whenever there is sufficient support for the end feeding to encounter. The availability and low cost production of tubular blanks, and the fact that tubes provide opposing ends that allow for the countering of two end feeding forces make THF a primary application for the present invention.

What is therefore needed is a technique for end feeding that reduces the friction in the nip area, thereby allowing for more end feeding and/or less wear on the parts in the nip area.

SUMMARY OF THE INVENTION

Applicant has discovered that by isolating the end feeding region from the internal pressure, the friction between the tube and the die is greatly reduced and as a result the end feeding force necessary to feed material to the expansion zone is greatly reduced. With the intelligent use of seals, more material can be fed to the expansion zone, with less force, and less attendant wear on the parts in the nip.

Accordingly an end plunger for end feeding in a hydroforming process is provided. The end plunger comprises a body designed to communicate an end feeding force onto a blank, the body having a bearing surface at a base end for bearing the end feeding force; a mandrel section at an insertion end opposite the bearing end, the mandrel having a shape and size for insertion within a channel of the blank; and a gripping surface for gripping the blank at its channel. The mandrel section has one or more seals defining a sealing area for sealing against an interior volume of the blank channel, wherein the sealing area extends across a length of the blank, the length being great enough so that during an end feeding operation, a seal is lost at one axial location of the tube due to bulging of the blank, and a seal remains at an axial position where the blank has undergone less dilation.

In some embodiments the body comprises a fluid communication channel for conducting high pressure fluid between the sealed inner volume of the blank and one of a pressurized fluid supply.

The body may be formed of a plurality of parts, including one independently attachable or removable module for each of a plurality of seals, or may be formed of a single part having a plurality of independently removable seals. The body may be generally cylindrical, and the bearing surface at the base end may have a larger diameter than the mandrel.

The bearing surface may be an adapter for coupling the end plunger to a ram of one of a pneumatic, and a hydraulic cylinder.

The mandrel section may have, across the sealing area, one or more of: a same cross-section; a same cross-sectional area; a same cross-sectional shape; a same cross-sectional shape and orientation; a same cross-sectional shape with a curvature and/or torsion along the mandrel section; a circular cross-section; an elliptical cross-section; and a circular cross-section but for one or more flattened sides.

The sealing area may be more than 2 cm long, more than 5 cm long or more than 10 cm long. The sealing area length may be more than a mean radius of the OD of the mandrel section, or more than twice or four times the mean radius of the OD of the mandrel section. The sealing area may include a plurality of independently releasable seals for sequential release during the end feeding. For example, the plurality of independently releasable seals comprise: at least one toric seal; 2-5 seals; at least one toric seal with a O (solid or hollow), X, U, V, T, square (solid or hollow), star or asterix profile; a proximal seal designed to seal a lip of the blank; a proximal seal having a pac-man or L shaped cross-section; a distal seal defining an insertion tip of the insertion end; different types, gages, strengths or dimensions of seals; a seal that is compression activated as a part of a gasket; a seal that is compression activated as a part of a gasket, where the activation is provided by electric, electromagnetic, fluid dynamic, and/or mechanical actuation. The end plunger may further comprise spacers for separating the plurality of releasable seals.

Also accordingly a method for end feeding is provided, the method comprising: placing a blank in a hydroforming die with a channel section of the blank lying in an entry channel of the die; inserting a mandrel section of the end plunger into the channel section of the blank; bringing a gripping surface of the end plunger into contact with the channel section of the blank; establishing a first seal for sealing the end plunger against an interior volume of the blank at a first position remote from the channel section; applying a high pressure forming fluid into the interior volume of the blank to bulge the blank outwardly, and end feeding the blank by applying an end feeding force to the end plunger, which communicates the force to the blank at the gripping surface, while the first seal isolates a section of the blank, from the channel to the first seal, from the fluid pressure; bulging the blank until the first seal is broken; and maintaining a second seal between the blank and the end plunger at a position within the channel. It will be appreciated that the order of these method steps is generally irrelevant, except as logically required. For example, it is impossible to establish the first seal before the mandrel section is inserted into the channel section of the blank.

Applying the high pressure forming fluid may comprise injecting the high pressure forming fluid through a fluid passage that extends through the end plunger.

A previous step of pre-configuring the end plunger for establishing the first and second seals at appropriate locations for the die, the blank, the forming fluid pressure and temperature, and the end feeding procedure may be performed.

Establishing the first seal may comprise actuating a gasket to effect the sealing.

In one embodiment, placing the blank in the hydroforming die comprises placing a plurality of channel sections of the blank in corresponding respective entry channels of the die; inserting the mandrel section of the end plunger comprises inserting respective mandrel sections of respective end plungers in each of the plurality of channel sections; and bringing the gripping surface of the end plunger into contact with the channel section of the blank, is performed for each end plunger at each channel section. The end feeding may be performed at two or more of the end plungers. If so, it may be preferable that forces of the end feeding are substantially balanced, for example, as provided if the blank is tubular, and the end feeding is provided coaxially at two opposite ends.

Also accordingly a kit is provided, the kit comprising: an end plunger having a body for communicating an end feeding force onto a blank, the body having a mandrel section for insertion into a blank, the mandrel section having a proximal seal for sealing the end plunger against an interior volume of the blank at a first section of the blank, and a distal seal for sealing the end plunger against the interior volume at a second section of the blank; and one or more of the following: a die having a cavity with a shape to receive and enclose the blank with the end plunger inserted into the blank, with a gripping surface of the end plunger gripping the blank, while a channel section of the blank extends through an entry channel of the die, which has a diameter that closely matches an outer diameter of the channel section, in which the first section is within the channel and the second section lies beyond the channel; or instructions for enclosing the blank in a die with the end plunger inserted into the blank, with a gripping surface of the end plunger gripping the blank, while a channel section of the blank extends through an entry channel of the die, which has a diameter that closely matches an outer diameter of the channel section, in which the first section is within the channel and the second section lies beyond the channel. The kit may further comprise the blank, or instructions for producing the blank.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Features of an invented end plunger for end fed tube or closed cavity hydroforming are provided, and a method, kit and apparatus including the end plunger, are provided.

Figure 1:
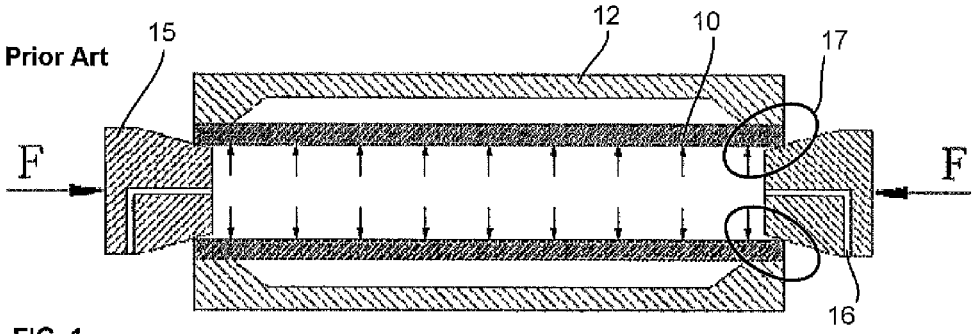
FIG. 1 is a schematic illustration of prior art equipment for end fed tube hydroforming.
Figure 2A:
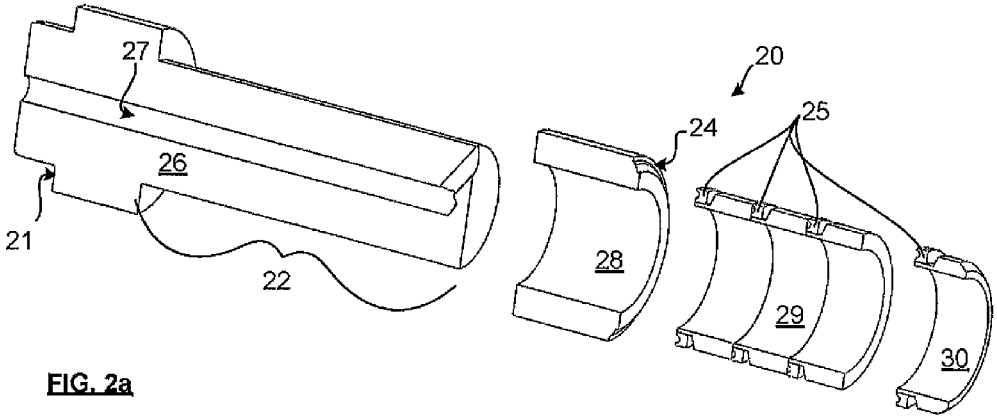
FIGS. 2*a,b* are schematic illustrations of an end plunger in accordance with an embodiment of the present invention in exploded and assembled view.
Figure 2B:
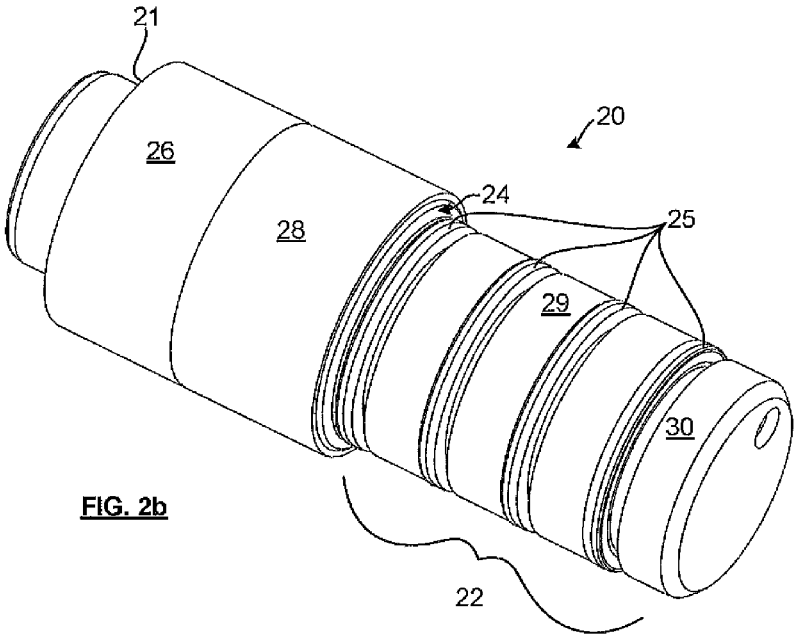

FIG. 2 shows a first embodiment of an end plunger in accordance with the present invention. The end plunger 20 may be formed of any number of parts, fabricated using a variety of methods, but when assembled for use, comprises at least: a bearing surface 21 at a base end, for bearing an end feeding force, for example supplied by a ram of a pneumatic, or hydraulic cylinder; a mandrel section 22 at an insertion end, for insertion within a blank (not in view), and a gripping surface 24 for gripping the tubular blank. The blank has at least a channel section for receiving the mandrel section 22, and a closed chamber, in fluid communication with the channel section. As such, the plunger 20 is designed to communicate the end feeding force from the bearing surface 21 onto the blank. The mandrel section 22 has one or more seals 25 defining a sealing area for sealing an interior volume of the blank, wherein the sealing area extends across a length of the blank so that during an end feeding operation, a seal is lost at one axial location of the tube due to bulging of the blank, a second seal remains at an axial position where the blank has undergone substantially no dilation. It is particularly preferred that, after a first seal is broken, a seal remains between a tube end and the region where the blank is deforming at a greatest rate, so that the nip area is in a region of low pressure.

While FIG. 2 shows a particular embodiment that has a channel 27 for communication of pressurized fluid, it will be appreciated that this is not required for the present invention. A plurality of through-bores may alternatively be provided, for example for removing air, or injection and/or removal of the pressurized fluid. For example, if one end of the blank 10 has one or more channels, sufficient for injection and removal of the pressurized fluid, and releasing air, the other end plunger may not require any. Furthermore, controlled delivery of pressurized fluid may be via another access to the blank 10 that is remote from the end feeding region.

More specifically, FIG. 2 shows an end plunger 20 with a body 26 having a generally cylindrical form that defines the bearing surface 21 at the base end, which has a greater outer diameter (OD) than an insertion end. The transition between the insertion end and base end is abrupt, forming a shoulder. The insertion end has a constant OD, as shown in exploded view of FIG. 2*a*, and the OD is substantially smaller than an inner diameter (ID) of the blank. As such, the insertion end allows a plurality of rings to be mounted to the body 26, and in the current arrangement, there are 5 such rings: a tube collar 28, three seal holders/spacers 29, and a tip 30.

The tube collar 28 has a same OD as the body 26, and has on the distal (insertion facing) end, the gripping surface 24. After this surface, the OD of the tube collar 28 is less than (or at least substantially less than) the ID of the blank, whereas on the proximal end of the tube collar 28 the OD is greater than the ID of the blank, so that the blank lip will encounter the gripping surface 24, and the gripping surface 24 can communicate the end feeding force to the blank. One advantage of providing this gripping surface 24 on a separate piece as the body 26, is that the relatively small surface area of the gripping surface 24 leads to a faster wearing out of the part, and replacement of the part is cost effective in comparison with replacement of the end plunger 20.

The abrupt transition between the insertion and base ends of body 26 provide an abutment surface for the tube collar 28, as the distal end of the tube collar 28 provides an abutment surface for seal holders/spacers 29, and each such ring supports the next in sequence. The number of seals 25 (which may be independently replaceable elastomeric seals) depends on the amount of end feeding that is required, a pliability of the blank, a length of the sealing area, and a length of the die cavity where deformation of the blank is minimal (an end feeding region).

It will be noted that accordance with some implementations of the present invention, because the blank does not press against the die cavity in the end feeding region, the end feeding region can be made substantially longer than in the prior art, without increased resistance. This can permit more end feeding, and can support the blank across a longer dimension, against pitch and yaw. Alternatively, given that the engineering requirements for the end feeding region are now markedly different than what is required for the die cavity, the end feeding region can be fabricated of a different material, or otherwise as a component separate from the die, as the die and end feeding region may be expected to wear differently. If the blank is never under pressure, except in the die cavity, there may actually be no enclosure around the blank in the end feeding region, or on a part thereof, or the enclosure may be reduced to a level sufficient for preventing buckling of the blank under the end feeding forces. Furthermore, the gripping of the blank may be provided over a larger surface area, by allowing the blank to be gripped on its outer surface, at least during an initial part of the end feeding. As such an external support for the blank in the end feeding region may include a region that supports the blank initially, and then supports a larger OD surface of the end plunger as the end feeding continues. The end plunger may also include a telescoping outer sheath for covering the outer surface of the blank and preventing buckling during end feeding of the blank where the blank has not yet entered the die cavity.

FIG. 2 shows four seals 25, each neighbouring seal 25 separated by a seal holder/spacer 29. The seals may preferably be independently replaceable elastomeric seals, for low temperature operation, but can be metallic seals if higher temperature application is required, such as for thermal hydroforming. The advantages and disadvantages of thermal hydroforming are well known in the art, including improved ductility of most metal blanks, and increased cost.

A proximal seal is adjacent to the gripping surface 24. The seals 25 may be toric seals with O (solid or hollow), X, U, V, T, star or asterix profiles, or generally annular seals having any desired cross-section. Generally the seals may be seated in grooves of a supporting wall. Such grooves may be radially facing, or may be chamfered, but is typically rotationally symmetric about the axis of the end plunger 20, if the blank has a circular cross-section, and provides uniform sealing along the perimeter in the more general case. A proximal seal 25 may be designed to seal a lip of the blank 10 and therefore may have a pac-man or L shaped cross-section. A distal seal 25 may have a different shape too, and may define a tip of the insertion end, in alternative embodiments.

The seals do not all have to be the same type, gage, strength or dimension. For example, if the distal seals are expected to sealingly engage the blank 20 while the blank moves a substantially greater distance than the proximal seals, they may be of a more resilient, motion bearing type, such as an X-ring configuration, whereas proximal seals 25 may be of a type that seal better when substantially static, such as square-ring seals.

While the illustrated embodiment shows seals supported by holders/spacers 28, this design could be substantially inverted, with seals comprising the bulk of the rings, and brass washers or the like defining spacers between sections of the seals, the washers serving to constrain membrane movement of the sections, to provide independent sealing sections. Further alternatives may involve no spacers at all and provide a single seal across the sealing area that extends a substantial depth, to permit continuous release over the sealing area, as the blank bulges.

In some embodiments the seals 25 are compressed (preferably axially) so that they extend further radially, and thus each seal 25 may be part of a gasket. Axially driven clamps, including clamps that are driven during locking or assembly of the holders/spacers 28 are shown in FIG. 2, where the interface between the seals 25 and the holders/spacers 29 is designed such that fastening the tip 30 with some extra torque compresses the seals 25, to improve the contact between the seals 25 and the blank. This can help maintaining the seal at the early stages of pressurizing.

Alternatively the compression may be provided using electroactive polymers, piezoelectric materials, shape memory alloys, or other electric or electromagnetic actuation, and/or with fluid dynamic (such as pneumatic/hydraulic) actuation, and/or with mechanical actuation, e.g. using a clamping mechanism, and/or the bearing force of the end feeding. The compressive force may be provided or augmented with end feeding force during the end feeding, for example, if the holders/spacers 29 contract under the forces of end feeding and its resistance. It may be necessary or preferable to actuate the seals 25 only after insertion of the end plunger 20 into the blank 10. It will be noted that the end feeding apparatus, or components thereof, may have rotational freedom, and this may be used to assemble, lock, and/or compress seals of the end plunger 20.

The seal holders/spacers 29 may be composed of a polymer or a metal. If formed of a polymer, one may combine the seal 25 and the seal holder/spacer 29 into a monolithic piece.

Once the elastomeric seals are assembled, a tip 30 of plunger is put in place to keep the seals together, and to improve insertion of the plunger into the blank prior to hydroforming and end feeding. The mounting of the rings (collar 28, holders/spacers 29, and tip 30) can be provided in any convenient and reliable manner, including direct threaded coupling, with bolts, or with snap together locking features, although this is not at all essential, and the assembly may be adhered, bonded, brazed, welded or fused together using any known techniques, and further the end plunger 20 may be substantially monolithic.

While holders/spacers 29 may have an OD close to the ID of the blank, and this, along with the closeness of the wall of die, is expected to limit thickening or crumpling of the blank, given that the material deforms much more easily where it is already deforming, there is no requirement for the spacers to substantially fill the area between the seals 25, except to the extent that pressure drop within the blank that occurs upon breach of a seal, is problematic.

One or more of the seals 25 may be an inflatable bladder. Flow of pressurized fluid into and out of the bladder may be used to initiate seals, and/or to decrease sealing when a desired bulging has been achieved at a desired location, for example. Gradual decrease in volume of the bladder relieves pressure drops within the blank upon seal breach. It will be appreciated that the very high pressures to which the blank, and therefore the interface between the blank and end plunger, is subjected, is expected to overbear considerable forces and a seal with an inflatable bladder would have to counter such a force.

The blank may have a uniform circular cross-section, in other embodiments the blank may be bent and/or torsioned, and it may have an elliptical, rectangular, partially flattened or irregular cross-section, or may have any other cross-section (uniform or varying as a function of depth) that permits the insertion of the mandrel section. The mandrel seals across the channel end of the blank in at least two places having different axial positions, using seals and structures known in the art.

If the blank does not have monotonic tapering, it may be necessary for the seals to be actuable, in order for the end plunger to be inserted to a desired depth of the blank. In general, two alternatives exist for inserting the end plunger into the blank, either the plunger can provide sufficient resistance to allow for the forcing of the plunger with the seals into the blank, with the deformation of the seals and/or blank allowing for the passage of the plunger, or there can be substantially less resistance to the insertion of the blank. For example, if the cross-section is not circular, orientation of movable independent seal modules can allow for easy and accurate positioning from outside of the blank and die, followed by reorientation and locking of the seals in place, may be preferred. An easily envisaged case is a blank with an oval cross-section of uniform orientation, and cross-sectional area as a function of depth. By inserting the seal members with the major axis tilted in the axial direction, and rotating the minor axis in the direction of the major axis of the blank, the seals can move without resistance. Tilting the seals back in the two directions will reorient the seals for sealing against the blank.

FIG. 3*a-c* schematically illustrate the end feeding operation using the end plunger 20 of FIG. 2, with particular illustration of the bulging of the blank 10 and the consequent release of seals. In FIG. 3*a*, the end plunger 20 is inserted within the blank 10, the seals 25 are actuated, and the assembly is within a hydroforming die. The blank 10 is pressurized and begins to bulge. At the early stages of hydroforming, the distal seal seals against the blank, isolating the blank wall between the distal seal and the base of the end plunger 20, from the internal pressure. Consequently, the blank 10 at the end feeding region is not under pressure, and the friction remains low in the nip area 17. So initially only the first seal resists the pressurized fluid. The end feeding is applied. At the point captured in FIG. 3*b*, the first seal has been broken, and the second most distal seal is about to be broken, and thus the pressure within the blank 10 is applied to the second most proximal seal. The blank 10 has substantially deformed, expanding in the die cavity 12' towards the die wall. The point in the end feeding process shown in FIG. 3*c* has all but the proximal seal broken, and a blank wall that conforms with the die cavity. In most applications the proximal seal is never broken during the end feeding and hydroforming.

It will be understood that multiple seals across the sealing area effectively relocates the nip area to where the seal remains intact against the blank 10, which changes with the bulging of the blank 10, during hydroforming and end feeding. In practice, the sealing area may extend a distance greater than ½, a diameter of the sealing OD, more preferably greater than the sealing OD, or more than twice the sealing OD, or a distance so that a first seal extends at least about 2 cm, more preferably more than 5 or 10 cm, into the die cavity at maximum insertion, so that a substantial area of the blank is not under pressure in the nip area of the die during initial bulging.

Figure 3:
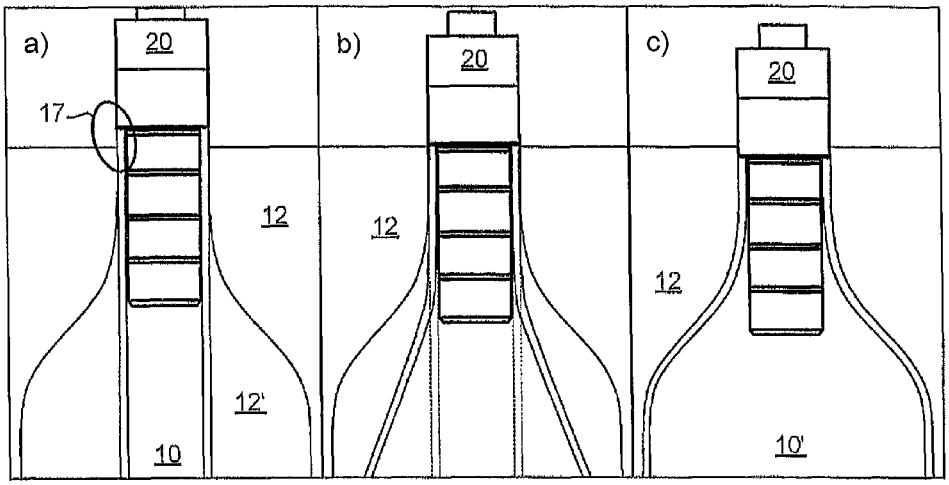
FIGS. 3*a,b,c* are schematic illustrations of the end plunger of FIG. 2 at three stages in an end fed tube hydroforming process.

While the embodiment of FIG. 3 shows entry of the end plunger 20 into the die, through an entry channel, in some embodiments the end plunger 20 may not enter such an entry channel, which may be much shorter, and means external to the die cavity may be required for alignment and orientation of the blank and/or end plunger assembly with respect to the die cavity. Advantageously, this may facilitate gripping of the blank over a wider surface area, as the blank end, where it is gripped, may never enter the die. Alternatively, and a distinct advantage over the prior art, an end feeding region of the die cavity can be elongated in a manner that was not practical in the prior art. As the nip area is effectively dislocated to a region of the die that is closer to a centre of the die, increased support (against pitch, yaw, and buckling) may be provided with an elongated end feeding region without the attendant friction that would have made such a die impractical before the present invention. The length of the seal area can be chosen in proportion to the length of the end feeding region of the die, although the end fed portion of the blank need not be strictly contained within the end feeding region.

Figure 4:
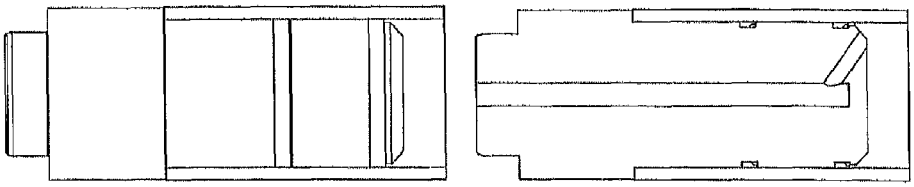
FIG. 4 schematically illustrates a monolithic embodiment of an end plunger in accordance with an alternative embodiment of the invention.

FIG. 4 is a schematic illustration of another embodiment of a monolithic end plunger 31 in accordance with the present invention, in partial cut out, and cross-section views, respectively. Substantially reducing a parts count, the end plunger 31 has a single body construction, with a plurality of grooves, each adapted to support a toric seal. Only two such grooves are shown, and each has a respective toric seal, however a plurality of grooves may be provided, to allow a variety of seals, at a variety of locations.

Figure 5:
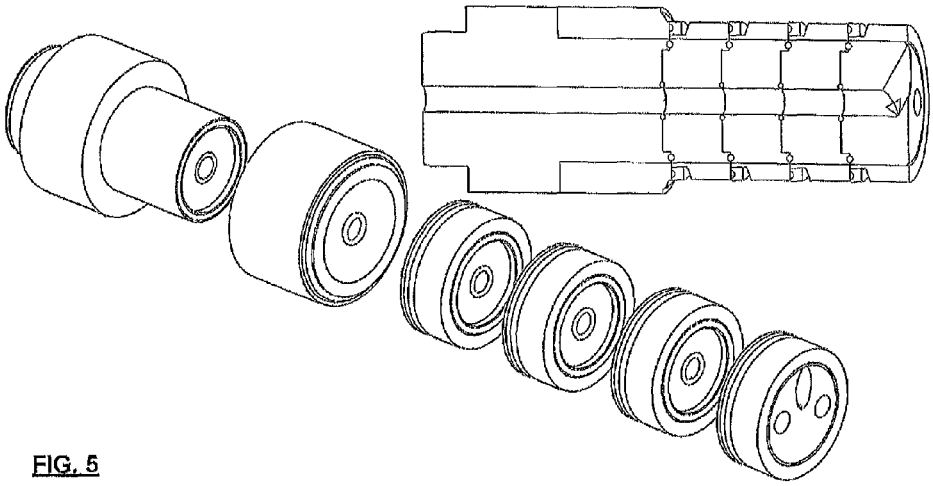
FIG. 5 schematically illustrates a modular embodiment of an end plunger in accordance with a further embodiment of the invention.

Another embodiment of the present invention is a modular design of the end plunger, as shown in FIG. 5 (which includes an exploded view and an assembled cross-sectional view). In the modular approach, each sealing stage is considered as a separate module, and these modules can be assembled on top of each other. The modular apparatus provides greater flexibility in that different amounts of end feeding is possible during hydroforming. In addition, this approach allows sealing on bent sections by using spherical modules, similar to mandrels known in the art of rotary draw bending processes.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. An end plunger for end feeding in a hydroforming process, the end plunger comprising:

a body having a strength to communicate an end feeding force onto a blank, the body having:

a bearing surface at a base end for bearing the end feeding force;

an insertion end opposite the base end, the insertion end bearing a mandrel having a shape and size for insertion within a channel of the blank; and a gripping surface for gripping the blank at its channel;

wherein the mandrel has one or more seals defining a sealing area for sealing against an interior volume of the blank channel, a length of the sealing area is more than a mean radius of the OD of the mandrel, whereby, during an end feeding operation, a seal is lost at one axial location due to bulging of the blank, and a seal remains at an axial position where the blank has undergone less bulging.

2. The end plunger of claim 1 wherein the body comprises a fluid communication channel for conducting high pressure fluid between the sealed interior volume of the blank and one of a pressurized fluid injector and vent.

3. The end plunger of claim 1 wherein the body is formed of a single part having a plurality of independently attachable or removable seals.

4. The end plunger of claim 1 wherein the bearing surface is an adapter for coupling the end plunger to a ram of one of a pneumatic, and a hydraulic cylinder.

5. The end plunger of claim 1 wherein the gripping surface interfaces a butt end of the blank channel.

6. The end plunger of claim 1 wherein the mandrel has, across the sealing area, one or more of: a same cross-section; a same cross-sectional area; a same cross-sectional shape; a same cross-sectional shape and orientation; a same cross-sectional shape with a curvature and/or torsion along the mandrel section; a circular cross-section; an elliptical cross-section; and a circular cross-section but for one or more flattened sides.

7. The end plunger of claim 1 wherein the sealing area is more than 2 cm long.

8. The end plunger of claim 1 wherein the body is generally cylindrical, and the bearing surface at the base end has a larger diameter than the mandrel.

9. The end plunger of claim 1 wherein the sealing area includes a plurality of independently releasable seals for sequential release during the end feeding.

10. The end plunger of claim 9 wherein the plurality of independently releasable seals comprise:

at least one toric seal;

2-5 seals;

at least one toric seal with a O (solid or hollow), X, U, V, T, square (solid or hollow), star or asterix profile;

a proximal seal designed to seal a lip of the blank;

a proximal seal having a pac-man or L shaped cross-section;

a distal seal defining an insertion tip of the insertion end;

different types, gages, strengths or dimensions of seals;

a seal that is actuable to seal or release;

a seal that is compression activated as a part of a gasket; or a seal that is compression activated as a part of a gasket, where the activation is provided by electric, electromagnetic, fluid dynamic, and/or mechanical actuation.

11. A method for end feeding, the method comprising:

placing a blank in a hydroforming die with a channel section of the blank lying in an entry channel of the die;

inserting a mandrel section of an end plunger into the channel section of the blank;

bringing a gripping surface of the end plunger into contact with the channel section of the blank;

establishing a first seal for sealing the end plunger against an interior volume of the blank at a first position remote from the channel section;

applying a high pressure forming fluid into the interior volume of the blank to bulge the blank outwardly, and end feeding the blank by applying an end feeding force to the end plunger, which communicates the force to the blank at the gripping surface, while the first seal isolates a section of the blank from the channel to the first seal, from the fluid pressure;

bulging the blank until the first seal is broken; and maintaining a second seal between the blank and the end plunger at a position within the channel.

12. The method of claim 11 wherein applying the high pressure forming fluid comprises injecting the high pressure forming fluid through a fluid passage that extends through the end plunger.

13. The method of claim 11 further comprising a previous step of preconfiguring the end plunger for establishing the first and second seals at appropriate locations for the die, the blank, the forming fluid pressure and temperature, and the end feeding procedure.

14. The method of claim 11 wherein establishing the first seal comprises actuating a gasket to effect the sealing.

15. The method of claim 11 wherein:

placing the blank in the hydroforming die comprises placing a plurality of channel sections of the blank in corresponding respective entry channels of the die;

inserting the mandrel section of the end plunger comprises inserting respective mandrel sections of respective end plungers in each of the plurality of channel sections; and bringing the gripping surface of the end plunger into contact with the channel section of the blank, is performed for each end plunger at each channel section.

16. The method of claim 15 wherein end feeding is performed at two or more of the end plungers.

17. The method of claim 15 wherein end feeding is performed at two or more of the end plungers, and the forces of the end feeding are substantially balanced.

18. The method of claim 17 wherein the blank is tubular, and the end feeding is provided coaxially at two opposite ends.

19. A kit comprising:

an end plunger having a body for communicating an end feeding force onto a blank, the body having a mandrel section for insertion into a blank, the mandrel section having a proximal seal for sealing the end plunger against an interior volume of the blank at a first section of the blank, and a distal seal for sealing the end plunger against the interior volume at a second section of the blank;

and one or more of the following:

a die having a cavity with a shape to receive and enclose the blank with the end plunger inserted into the blank, with a gripping surface of the end plunger gripping the blank, while a channel section of the blank extends through an entry channel of the die, which has a diameter that closely matches an outer diameter of the channel section, in which the first section is within the channel and the second section lies beyond the channel; or instructions for enclosing the blank in a die with the end plunger inserted into the blank, with a gripping surface of the end plunger gripping the blank, while a channel section of the blank extends through an entry channel of the die, which has a diameter that closely matches an outer diameter of the channel section, in which the first section is within the channel and the second section lies beyond the channel.

20. The kit of claim 19 further comprising the blank, or instructions for producing the blank.

21. An end plunger for end feeding in a hydroforming process, the end plunger comprising:

a body formed of a plurality of parts, including one independently attachable or removable module for each of a plurality of seals, the body having a strength to communicate an end feeding force onto a blank, the body comprising:

a bearing surface at a base end for bearing the end feeding force;

an insertion end opposite the base end, the insertion end bearing a mandrel having a shape and size for insertion within a channel of the blank; and a gripping surface for gripping the blank at its channel;

wherein the plurality of seals are provided on the mandrel, and define a sealing area for sealing against an interior volume of the blank channel, wherein a length of the sealing area is great enough so that during an end feeding operation, a seal is lost at one of the plurality of seals due to bulging of the blank, and a seal remains at another of the plurality of seals at an axial position where the blank has undergone less bulging.

22. The end plunger of claim 21 wherein the body comprises a fluid communication channel for conducting high pressure fluid between the sealed interior volume of the blank and one of a pressurized fluid injector and vent.

23. The end plunger of claim 21 wherein the gripping surface interfaces a butt end of the blank channel.

24. The end plunger of claim 21 wherein the mandrel has, across the sealing area, one or more of: a same cross-section; a same cross-sectional area; a same cross-sectional shape; a same cross-sectional shape and orientation; a same cross-sectional shape with a curvature and/or torsion along the mandrel section; a circular cross-section; an elliptical cross-section; and a circular cross-section but for one or more flattened sides.

25. The end plunger of claim 21 wherein the sealing area length is more than a mean radius of the OD of the mandrel.

26. The end plunger of claim 21 wherein the body is generally cylindrical, and the bearing surface at the base end has a larger diameter than the mandrel.

27. The end plunger of claim 21 wherein the sealing area includes a plurality of independently releasable seals for sequential release during the end feeding.

28. The end plunger of claim 27 wherein the plurality of independently releasable seals comprise:

at least one toric seal;

2-5 seals;

at least one toric seal with a O (solid or hollow), X, U, V, T, square (solid or hollow), star or asterix profile;

a proximal seal designed to seal a lip of the blank;

a proximal seal having a pac-man or L shaped cross-section;

a distal seal defining an insertion tip of the insertion end;

different types, gages, strengths or dimensions of seals;

a seal that is actuable to seal or release;

a seal that is compression activated as a part of a gasket; or a seal that is compression activated as a part of a gasket, where the activation is provided by electric, electromagnetic, fluid dynamic, and/or mechanical actuation.

29. An end plunger for end feeding in a hydroforming process, the end plunger comprising:

a body having a strength to communicate an end feeding force onto a blank, the body comprising:

a bearing surface at a base end for bearing the end feeding force;

an insertion end opposite the base end, the insertion end bearing a mandrel having a shape and size for insertion within a channel of the blank;

a plurality of independently releasable seals on the mandrel for sequential release during the end feeding, the plurality of seals defining a sealing area for sealing against an interior volume of the blank channel;

a spacer for separating the independently releasable seals; and a gripping surface for gripping the blank at its channel;

wherein a length of the sealing area is great enough so that during an end feeding operation, one of the plurality of seals is lost due to bulging of the blank, and another of the plurality of seals remains at an axial position where the blank has undergone less bulging.

* * * * *